US007820012B2

(12) United States Patent
Stewart

(10) Patent No.: US 7,820,012 B2
(45) Date of Patent: Oct. 26, 2010

(54) REVERSE BUMP TEST FOR CLOSED-LOOP IDENTIFICATION OF CD CONTROLLER ALIGNMENT

(75) Inventor: Gregory E. Stewart, Vancouver (CA)

(73) Assignee: Honeywell ASCa Inc., Mississauga (CA)

( * ) Notice: Subject to any disclaimer, the term of this patent is extended or adjusted under 35 U.S.C. 154(b) by 103 days.

(21) Appl. No.: 12/235,596

(22) Filed: Sep. 22, 2008

(65) Prior Publication Data

US 2009/0014142 A1 Jan. 15, 2009

Related U.S. Application Data

(62) Division of application No. 11/210,180, filed on Aug. 22, 2005, now Pat. No. 7,459,060.

(51) Int. Cl.
*D21F 1/66* (2006.01)

(52) U.S. Cl. ..... 162/263; 162/198; 700/128

(58) Field of Classification Search ..... 162/263, 162/198; 700/128, 129; 34/114
See application file for complete search history.

(56) References Cited

U.S. PATENT DOCUMENTS

| | | | | | |
|---|---|---|---|---|---|
| 4,767,935 | A | | 8/1988 | Anderson | |
| 4,786,817 | A | | 11/1988 | Boissevain | |
| 4,879,471 | A | * | 11/1989 | Dahlquist | 250/359.1 |
| 4,903,528 | A | | 2/1990 | Balakrishnan et al. | |
| 4,965,736 | A | | 10/1990 | Balakrishnan et al. | |
| 4,982,334 | A | | 1/1991 | Balakrishnan | |
| 5,022,966 | A | | 6/1991 | Hu | |
| 5,094,535 | A | * | 3/1992 | Dahlquist et al. | 356/451 |
| 5,121,332 | A | | 6/1992 | Balakrishnan et al. | |
| 5,315,124 | A | * | 5/1994 | Goss et al. | 250/497.1 |
| 5,400,258 | A | | 3/1995 | He | |
| 5,432,353 | A | * | 7/1995 | Goss et al. | 250/497.1 |
| 5,539,634 | A | | 7/1996 | He | |
| 5,838,561 | A | | 11/1998 | Owen | |
| 5,853,543 | A | | 12/1998 | Hu et al. | |
| 5,892,679 | A | | 4/1999 | He | |
| 5,944,955 | A | | 8/1999 | Bossen et al. | |
| 6,059,931 | A | | 5/2000 | Hu | |
| 6,080,278 | A | | 6/2000 | Heaven | |
| 6,086,237 | A | | 7/2000 | Gorinevsky et al. | |
| 6,092,003 | A | | 7/2000 | Hagart-Alexander | |
| 6,149,770 | A | | 11/2000 | Hu | |

(Continued)

OTHER PUBLICATIONS

Tim Mast, et al, New Optimization of CD Control for Global and Localized Profile Performance, TAPPI Spring Technical Conference & Trade Fair, Canada 2003.

*Primary Examiner*—Mark Halpern
(74) *Attorney, Agent, or Firm*—Cascio Schmoyer & Zervas

(57) ABSTRACT

A reverse bump test, for identifying the alignment of a sheet-making system while the system remains in closed-loop control, includes the following steps: (a) leaving the control system in closed-loop, (b) artificially inserting a step signal on top of the measurement (or setpoint) profile from the scanner, (c) recording the data as the control system moves the actuators to remove the perceived disturbance (or setpoint change), and (d) refining or developing a model from the artificial measurement disturbance (or setpoint change) to the actuator profile. The technique supplies the probing/perturbation signal to the scanner measurement, which is equivalent to supplying the probing/perturbation signal to the setpoint target) rather than inserting bumps via the actuator set points as has been practiced traditionally.

20 Claims, 8 Drawing Sheets

U.S. PATENT DOCUMENTS 6,168,687 B1 1/2001 Hu et al.
6,233,495 B1 5/2001 Chen
6,290,816 B1 9/2001 Graf
6,343,240 B1 1/2002 Shakespeare et al.
6,564,117 B1 5/2003 Chen et al.
6,647,354 B1 11/2003 Gorinevsky et al.
6,807,510 B1 10/2004 Backstrom et al.
6,850,857 B2 2/2005 Ignagni et al.
2004/0221978 A1 11/2004 Tran et al.
2004/0261965 A1 12/2004 Burma

* cited by examiner

REVERSE BUMP TEST FOR CLOSED-LOOP IDENTIFICATION OF CD CONTROLLER ALIGNMENT

REFERENCE TO RELATED APPLICATIONS

This application is a divisional application of U.S. patent application Ser. No. 11/210,180 that was filed on Aug. 22, 2005 now U.S. Pat. No. 7,459,060.

FIELD OF THE INVENTION

The present invention generally relates to techniques for monitoring and controlling continuous sheetmaking systems such as a papermaking machine and more, specifically to maintaining proper cross-directional alignment in sheetmaking systems by extracting alignment information from a closed-loop CD control system.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper (i.e., thickness) of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendaring rollers at the end of the process. Papermaking devices are well known in the art and are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking systems are further described, for example, in U.S. Pat. No. 5,539,634 to He, U.S. Pat. No. 5,022,966 to Hu, U.S. Pat. No. 4,982,334 to Balakrishnan, U.S. Pat. No. 4,786,817 to Boissevain et al, and U.S. Pat. No. 4,767,935 to Anderson et al. Process control techniques for papermaking machines are further described, for instance, in U.S. Pat. No. 6,149,770 to Hu et al., U.S. Pat. No. 6,092,003 to Hagart-Alexander et. al, U.S. Pat. No. 6,080,278 to Heaven et al., U.S. Pat. No. 6,059,931 to Hu et al., U.S. Pat. No. 5,853,543 to Hu et al., and U.S. Pat. No. 5,892,679 to He.

On-line measurements of sheet properties can be made in both the machine direction and in the cross direction. In the sheetmaking art, the term machine direction (MD) refers to the direction that the sheet material travels during the manufacturing process, while the term cross direction (CD) refers to the direction across the width of the sheet which is perpendicular to the machine direction.

Papermaking machines typically have several control stages with numerous, independently-controllable actuators that extend across the width of the sheet at each control stage. For example, a papermaking machine will typically include a headbox having a plurality of slice lip force actuators at the front which allow the stock in the headbox to flow out on the fabric of the web or wire. The papermaking machine might also include a steam box having numerous steam actuators that control the amount of heat applied to several zones across the sheet. Similarly, in a calendaring stage, a segmented calendaring roller can have several actuators for controlling the nip pressure applied between the rollers at various zones across the sheet.

All of the actuators in a stage are operated to maintain a uniform and high quality finished product. Such control might be performed, for instance, by an operator who periodically monitors sensor readings and then manually adjusts each of the actuators until the desired output readings are produced. Papermaking machines can further include computer control systems for automatically adjusting cross-directional actuators using signals sent from scanning sensors.

In making paper, virtually all MD variations can be traced back to high-frequency or low-frequency pulsations in the headbox approach system. CD variations are more complex. Preferably, the cross-directional dry weight profile of the final paper product is flat, that is, the product exhibits no CD variation, however, this is seldom the case. Various factors contribute to the non-uniform CD profiles such as non-uniformities in pulp stock distribution, drainage, drying and mechanical forces on the sheet. The causes of these factors include, for example, (i) non-uniform headbox delivery, (ii) clogging of the plastic mesh fabric of the wire, (iii) varying amounts of tension on the wire, (iv) uneven vacuum distribution, (v) uneven press or calendar nip pressures, and (vi) uneven temperatures and airflows across the CD that lead to moisture non-uniformities.

Cross-directional measurements are typically made with a scanning sensor that periodically traverses back and forth across the width of the sheet material. The objective of scanning across the sheet is to measure the variability of the sheet in both CD and MD. Based on the measurements, corrections to the process are commanded by the control computer and executed by the actuators to make the sheet more uniform.

In practice, control devices that are associated with sheetmaking machines normally include a series of actuator systems arranged in the cross direction. For example, in a typical headbox, the control device is a flexible member or slice lip that extends laterally across a small gap at the bottom discharge port of the headbox. The slice lip is movable for adjusting the area of the gap and, hence, for adjusting the rate at which feedstock is discharged from the headbox. A typical slice lip is operated by a number of actuator systems, or cells, that operate to cause localized bending of the slice lip at spaced apart locations in the cross-direction. The localized bending of the slice lip member, in turn, determines the width of the feed gap at the various slice locations across the web.

It is standard practice that sheetmaking machines be controlled by adjusting actuators using measurement signals provided by scanning sensors. In the case of cross-directional control, for example, a commonly suggested control scheme is to measure values at selected cross direction locations on a sheet and then to compare those measured values to target or set point values. The difference for each pair of measured and set point values, i.e., the error, can be used for algorithmically generating appropriate outputs to cross direction control actuators to minimize the error. In such systems, a measurement zone is defined as the cross direction portion of sheet which is measured and used as feedback control for a cross direction actuator zone, and a control zone is defined as the portion of the sheet affected by a cross direction actuator zone.

In practice, it is difficult to control sheetmaking machines by adjusting actuators using measurement signals provided by scanning sensors. The difficulties particularly arise because the scanning sensors are separated from the control actuators by substantial distances in the machine direction. Because of such separations, it is difficult to determine which measurements zones are associated with which actuator zones. Such difficulties are referred to as alignment problems in the papermaking art. Alignment problems are exacerbated when, as is typical, there is uneven paper shrinkage of a paper web as it progresses through a papermaking process. Another difficulty is that the effect of each actuator is not always limited within the corresponding control zone but spans over a few control zones. Alignment is an important process model parameter for keeping the CD control system stable and operating. The alignment can change over time and subsequently degrade the controller performance and thus paper quality.

One conventional method for aligning actuator zones with measurement zones involves the use of dye tests. In a dye test, narrow streams of colored liquid are applied to feedstock as it flows beneath a slice lip. The dye streams initially form parallel lines that extend in the machine direction, but those lines may deviate from parallel if there is web shrinkage during the papermaking process. The dye marks passing through the measurement devices reveal the distribution of control zones and therefore specify the alignment of measurement zones.

Conventional dye tests, however, have numerous drawbacks. The most serious drawback is that the tests destroy finished product and, therefore, it is seldom feasible to perform dye tests at an intermediate point in a sheetmaking production run, even though sheetmaking processes are likely to drift out of control during such times. Further, because of the limited thickness and high absorption characteristics of tissue grades of paper, dye tests are typically limited to paper products that have relatively high weight grades.

More recently, systems that automatically and non-destructively map and align actuator zones to measurements zones in sheetmaking systems have been developed. Some of these systems perform so-called "bump tests" by disturbing selected actuators and detecting their responses, typically with the CD control system in open-loop. The term "bump test" refers to a procedure whereby an operating parameter on the sheetmaking system, such as a papermaking machine, is altered and changes of certain dependent variables resulting therefrom are measured. Prior to initiating any bump test, the papermaking machine is first operated at predetermined baseline conditions. By "baseline conditions" is meant those operating conditions whereby the machine produces paper of acceptable quality. Typically, the baseline conditions will correspond to standard or optimized parameters for papermaking. Given the expense involved in operating the machine, extreme conditions that may produce defective, non-useable paper are to be avoided. In a similar vein, when an operating parameter in the system is modified for the bump test, the change should not be so drastic as to damage the machine or produce defective paper. After the machine has reached steady state or stable operations, the certain operating parameters are measured and recorded. Sufficient number of measurements over a length of time is taken to provide representative data of the responses to the bump test.

The standard bump test for CD model identification includes the following steps: (1) placing a control system in open-loop; (2) bumping a subset of the actuators at the headbox to follow a step or series of steps in time; (3) collecting the output data as measured by sensor(s) in the scanner; and (4) running a model identification algorithm to identify the model parameters including alignment.

For example, U.S. Pat. No. 5,400,258 to He discloses a standard alignment bump test for a papermaking system in which an actuator is moved and its response is read by a scanning sensor and the alignment is identified by the software. U.S. Pat. No. 6,086,237 to Gorinevsky and Heaven discloses a similar technique but with more sophisticated data processing. Specifically, in their bump test the actuators are moved and technique identifies the response as seen by the scanner.

With current bump test alignment methods, the operator can identify the alignment at the time of the bump test experiment. To track alignment changes over time there is a need to re-identify alignment over the course of days and weeks. Moreover, model identification for a system in closed-loop control is well known to be challenging. This is due in part to the fundamental reason that a closed-loop control system works to eliminate any perturbations, so prior art techniques have endeavored to "sneak" a perturbation into the actuator profile that works against the rest of the system and attaining sufficient excitation of the system is difficult to achieve.

SUMMARY OF THE INVENTION

The present invention provides a novel method for identifying the alignment of a sheetmaking system while the system remains in closed-loop control. In contrast to the standard model identification techniques that are employed in conjunction with an open or closed-loop control system, the invention exploits the closed-loop control to its advantage. The technique can include the following steps: (1) leaving the control system in closed-loop, (2) artificially inserting a step signal on top of the measurement profile from the scanner (equivalently, inserting a step signal on top of a setpoint target profile), (3) recording the data as the control system moves the actuators to remove the perceived disturbance, and (4) refining or developing a model from the artificial measurement disturbance to the actuator profile.

The invention is based in part on the recognition that steady-state response of the actuator profile contains information from which the sheetmaking system alignment can be extracted.

In one embodiment, the invention is directed to a method for alignment of a sheetmaking system having a plurality of actuators arranged in the cross-direction wherein the system includes a control loop for adjusting output from the plurality of actuators in response to sheet profile measurements that are made downstream from the plurality of actuators, the method including the steps of:

(a) determining alignment information from at least two cross-directional positions by:

(i) operating the system and measuring a profile of the sheet along the cross-direction of the sheet downstream from the plurality of actuators and generating a profile signal that is proportional to a measurement profile;

(ii) adding a perturbative signal to the measurement profile (equivalently, adding a perturbative signal to a setpoint target profile) to generate a modified profile signal that simulates a disturbance (equivalently, a setpoint change) at a position along the measurement profile;

(iii) determining alignment shift information based on the closed-loop response of the actuator profile to the modified profile signal (or setpoint change); and (iv) repeating steps (i) through (iii) wherein step (ii) comprises adding a perturbative signal to the measurement profile (equivalently, adding a perturbative signal to a setpoint profile) to generate a modified profile signal that simulates a disturbance (equivalently, a setpoint change) at a different position along the measurement profile thereby obtaining alignment shift information from at least two cross-directional positions;

(b) identify the changes in alignment of the sheetmaking system, if any, from the alignment shift information from at least two cross-directional positions.

In another embodiment, the invention is directed to method for extracting cross-directional information from a sheetmaking system having a plurality of actuators arranged in the cross-direction wherein the system includes a control loop for adjusting output from the plurality of actuators in response to sheet profile measurements that are made downstream from the plurality of actuators, the method including the steps of:

(a) operating the system and measuring a profile of the sheet along the cross-direction of the sheet downstream from the plurality of actuators and generating a profile signal that is proportional to a measurement profile;

(b) adding a perturbative signal to the measurement profile (equivalently, adding a perturbative signal to a setpoint target profile) to generate a modified profile signal that simulates a disturbance (equivalently, a setpoint change) of at least one position along the measurement profile; and (c) determining cross-directional alignment information based on actuator responses to the modified profile signal.

In a further embodiment, the invention is directed to a system for alignment of a sheetmaking system having a plurality of actuators arranged in the cross-direction wherein the system includes a control loop for adjusting output from the plurality of actuators in response to sheet profile measurements that are made downstream from the plurality of actuators, the system comprising:

(a) means for determining alignment information from at least two cross-directional positions that includes:

(i) means for measuring a profile of the sheet along the cross-direction of the sheet downstream from the plurality of actuators;

(ii) generating a profile signal that is proportional to a measurement profile;

(iii) means for adding a perturbative signal to the measurement profile (equivalently, adding a perturbative signal to a setpoint target profile) to generate a modified profile signal that simulates a disturbance (equivalently, a setpoint change) at a position along the measurement profile; and (iv) means for determining alignment shift information based on the closed-loop response of the actuator profile to the modified profile signal; and (b) means for identifying the changes in alignment of the sheetmaking system, if any, from the alignment shift information from at least two cross-directional positions.

DETAILED DESCRIPTION OF PREFERRED EMBODIMENTS

Figure 1:
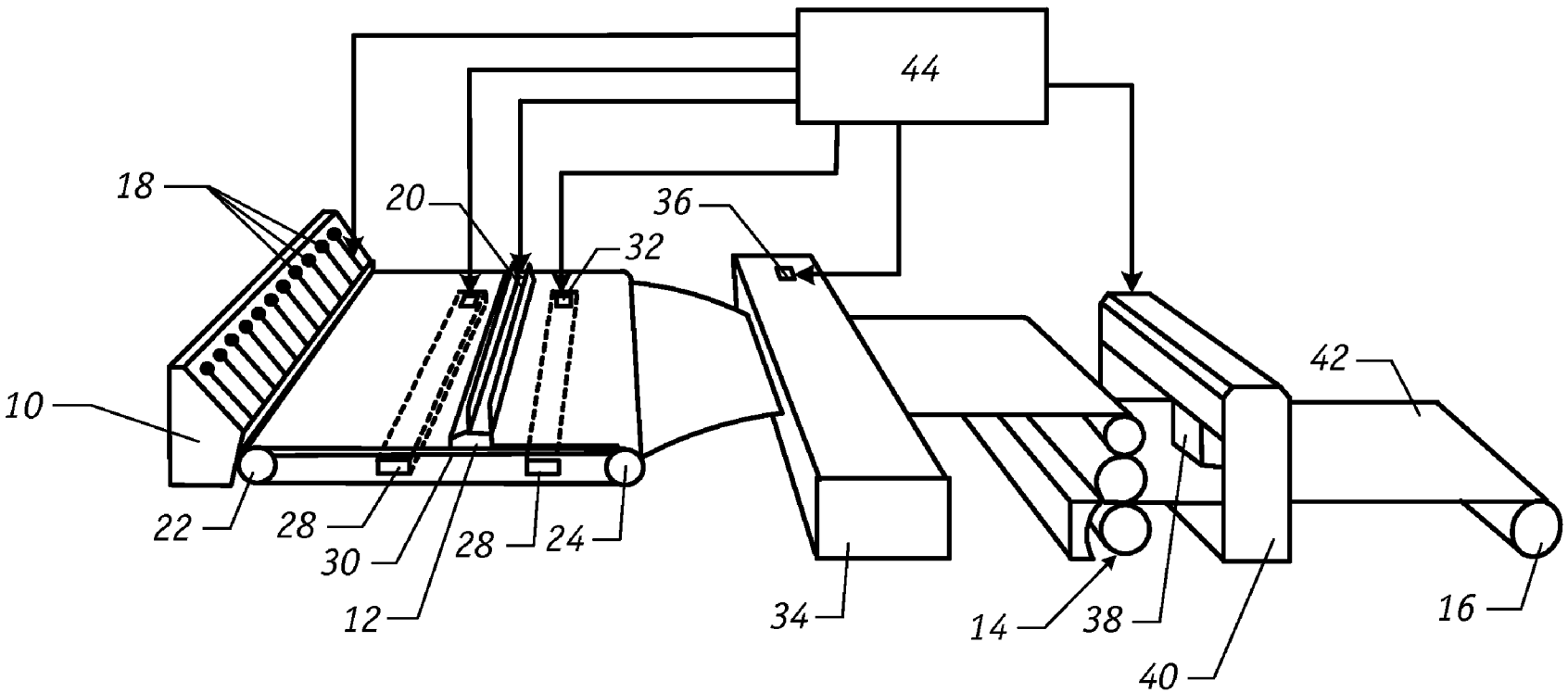
FIGS. 1, 2, and 3 are schematic illustrations of a papermaking system.

As shown in FIG. 1, a system for producing continuous sheet material includes various processing stages such as headbox 10, steambox 12, a calendaring stack 14 and reel 16. The array of actuators 18 in headbox 10 controls the discharge of wet stock (or feedstock) material through a plurality of slices onto supporting web or wire 30 which rotates between rollers 22 and 24. Similarly, actuators 20 on steambox 12 can control the amount of steam that is injected at points across the moving sheet. Sheet material exiting the wire 30 passes through a dryer 34 which includes actuators 36 that can vary the cross directional temperature of the dryer. A scanning sensor 38, which is supported on supporting frame 40, continuously traverses and measures properties of the finished sheet in the cross direction. Scanning sensors are known in the art and are described, for example, in U.S. Pat. No. 5,094,535 to Dalquist, U.S. Pat. No. 4,879,471 to Dalquist, et al, U.S. Pat. No. 5,315,124 to Goss, et al, and U.S. Pat. No. 5,432,353 to Goss et al, which are incorporated herein. The finished sheet product 42 is then collected on reel 16. As used herein, the "wet end" portion of the system includes the headbox, the web, and those sections just before the dryer, and the "dry end" comprises the sections that are downstream from the dryer. Typically, the two edges of the wire in the cross direction are designated "front" and "back" (alternatively, referred as the "high" and "low") with the back side being adjacent to other machinery and less accessible than the front side.

The system further includes a profile analyzer 44 that is connected, for example, to scanning sensor 38 and actuators 18, 20, 32 and 36 on the headbox 10, steam box 12, vacuum boxes 28, and dryer 34, respectively. The profile analyzer is a computer which includes a control system that operates in response to the cross-directional measurements from scanner sensor 38. In operation, scanning sensor 38 provides the analyzer 44 with signals that are indicative of the magnitude of a measured sheet property, e.g., caliper, dry basis weight, gloss or moisture, at various cross-directional measurement points. The analyzer 44 also includes software for controlling the operation of various components of the sheetmaking system, including, for example, the above described actuators.

Figure 2:
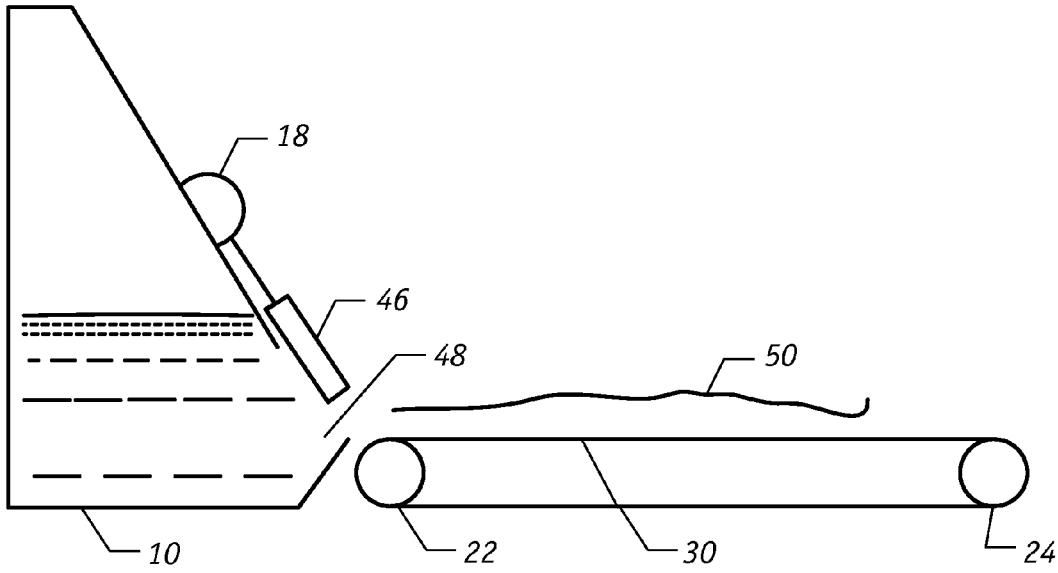

FIG. 2 depicts a slice lip control system which is mounted on a headbox 10 for controlling the extent to which a flexible slice lip member 46 extends across the discharge gap 48 at the base of the headbox 10. The slice lip member 46 extends along the headbox 10 across the entire width of the web in the cross-direction. The actuator 18 controls of the slice lip member 46, but it should be understood that the individual actuators 18 are independently operable. The spacing between the individual actuators in the actuator array may or may not be uniform. Wetstock 50 is supported on wire 30 which rotates by the action of rollers 22 and 24.

Figure 3:
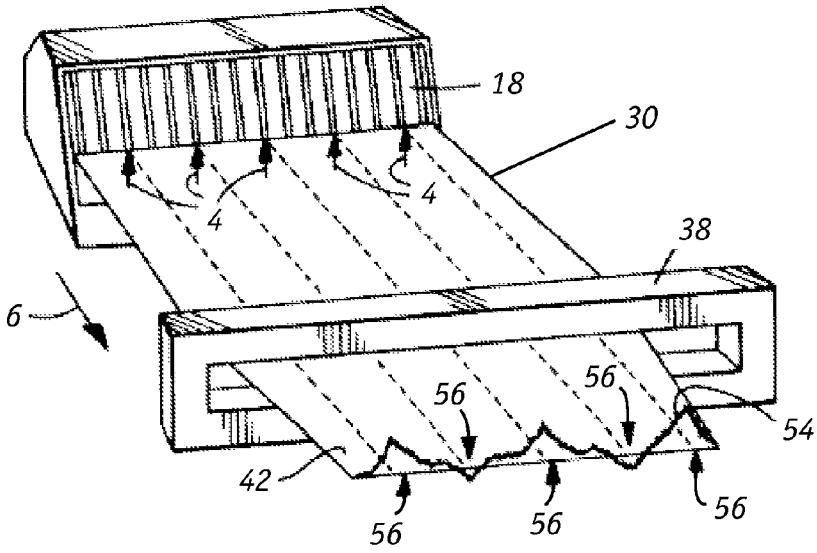

As an example shown in FIG. 3, the amount of feedstock that is discharged through the gap between the slice lip member and the surface of the web 30 of any given actuator is adjustable by controlling the individual actuator 18. The feed flow rates through the gaps ultimately affect the properties of the finished sheet material, i.e., the paper 42. Specifically, as illustrated, a plurality of actuators 18 extend in the cross direction over web 30 that is moving in the machine direction indicated by arrow 6. Actuators 18 can be manipulated to control sheet parameters in the cross direction. A scanning device 38 is located downstream from the actuators and it measures one or more the properties of the sheet. In this example, several actuators 18 are displaced as indicated by arrows 4 and the resulting changes in sheet property is detected by scanner 38 as indicated by the scanner profile 54. By averaging many scans of the sheet, the peaks of profile 54 indicated by arrows 56 can be determined. This type of operation is typically used in traditional open and closed-loop bump tests. In contrast, the inventive reverse bump test does not directly send perturbations to the actuator profile. It should be noted that besides being positioned in the headbox, actuators can be placed at one or more strategic locations in the papermaking machine including, for example, in the steamboxes, dryers, and vacuum boxes. The actuators are preferably positioned along the CD at each location.

Figure 4:
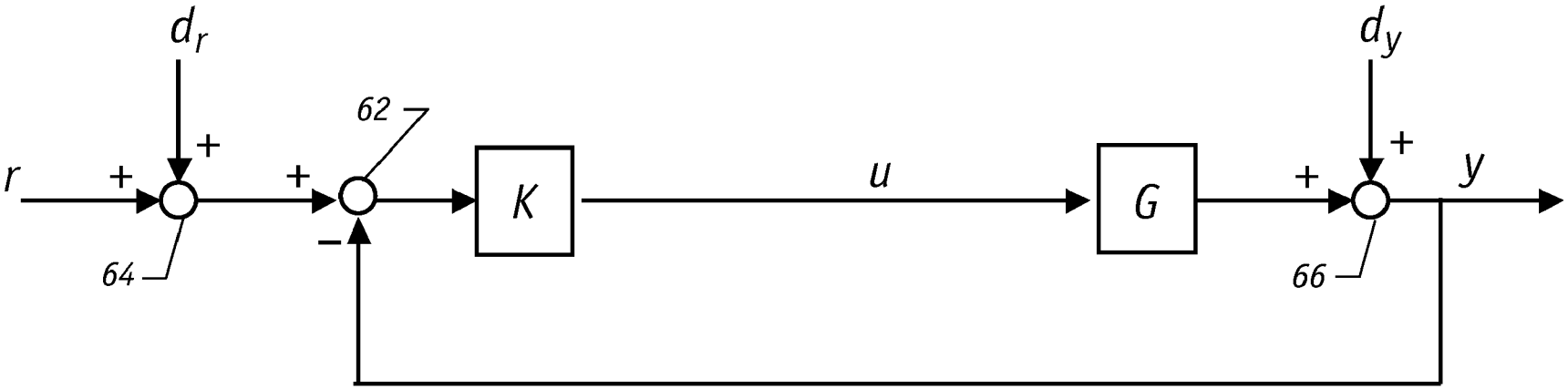
FIG. 4 is a block diagram of a sheetmaking system with the inventive reverse closed-loop bump test.

FIG. 4 illustrates an embodiment the closed-loop reverse bump test for a sheetmaking system such as that shown in FIG. 1. The term "reverse bump test" denotes that in contrast to standard model identification techniques that perturb one or more actuators and then extract information from the response, e.g., measurement profile from the scanner, the inventive technique artificially inserts a step signal $d_y$ on top of the measurement profile y (equivalently, a step signal $d_r$ on top of the setpoint target profile r) and then analyzes the actuator response while the system is under closed-loop control.

Referring to FIG. 4, the process employs a controller denoted by K for use with a profile analyzer for the sheetmaking system denoted G. Signals associated with this process include r, u, and y. The r signal represents a selected target or selected setpoint level, signal u represents the actuator signal, and signal y represents the measurement profile, e.g., scanner measurements. When controlling and measuring sheetmaking parameters in the cross direction, it is understood that the signals will be arrays or vectors, so that, for instance, y can be described as a vector whose ith component is the weight level or moisture level or thickness of a sheet at the ith position along a scanner. The signal $d_y$ represents an unmeasured disturbance or a perturbation or offset signal that is inserted in the measurement profile. The signal $d_r$ represents a perturbation or offset signal that is inserted on the target profile. The controller K can be any suitable closed-loop controller and may contain many signal processing components, for example, spatial and/or temporal filters, a proportional integral derivative (PID) controller, Dahlin controller, proportional plus integral (PI) controller, or proportional plus derivative (PD) controller, or a model predictive controller (MPC). An MPC is described in U.S. Pat. No. 6,807,510 to Backstrom and He, which is incorporated herein by reference. During normal production, a y signal profile is continuously generated by scanning the finished paper product and this signal is compared to the r signal for any error defined by $e=r-y$ when $d_r=0$.

The inventive closed-loop reverse bump test can be implemented to generate alignment data for any of the actuators that control cross direction operations of the various components for the sheetmaking system shown in FIG. 1 provided that the actuators are connected to the perturbed profile measurement y, setpoint r, or error e in the closed-loop through controller K. Therefore, while the invention will be illustrated by monitoring the actuators at the headbox which control that feedstock discharge through the individual slices, the invention can also be implemented to ascertain alignment data for any of the actuators that control cross directional unit operations in the sheetmaking machine including, for example, the steambox, dryer, and vacuum box.

In implementing the reverse bump test, a sheetmaking system G, such as a papermaking machine, is initially operated with actuators that are set by the feedback controller K to cause y to match a target signal profile r as closely as possible. During paper production, a y signal profile is generated by scanning the finished paper product. Thereafter, with the papermaking machine still in closed-loop control, the target profile is modified by inserting a pertubative signal $d_r$ to create a setpoint target profile at summer 64 of $r+d_r$. The measurement profile y signal profile from the scanner will be subtracted from the setpoint target profile at summer 62. Controller K will convert the error signal e from the comparator into an actuator signal profile u that is received by the papermaking machine. The effect will be that the papermaking machine feedstock discharge through the slice lip opening at the headbox that will be adjusted to have the measurement profile y follow the perceived change in setpoint target.

The following describes a preferred technique of implementing the inventive reverse bump test for closed-loop identification of CD controller alignment. In operation, the control system of the papermaking machine, for instance, is left in the closed-loop and a step signal is artificially inserted on top of the measurement profile from the scanner which measures the finished paper product. Data is recorded as the control system responds by adjusting the actuators at the headbox to remove the perceived perturbation. Finally, a model, which contains alignment information, is identified from the data comprising the artificial measurement disturbance and the resulting actuator profile. In actual implementation of the reverse bump test, the "bump" should not be so drastic as to cause the final product, e.g., paper, to be unfit for sale.

Reverse Bump Test Design and Data Collection Procedure (1) Design a bump test by designing the setpoint target bumps ($\delta r$).

a. Using a papermaking machine for illustrative purposes, preferably at least two well-separated "bump" are positioned in the cross-direction. For example, they can be located at ¼ and ¾ across the sheet width.

b. In the time domain, operate the machine at a baseline and then operate the machine in a plurality of steps up and down. The simplest technique is to execute a single step that lasts long enough for the closed-loop controller to reach its new steady state with the setpoint bumps.

(2) Run the reverse bump test. With the CD in closed-loop control, modify the setpoint target profile with ($r+\delta r$) as designed above. While logging the data for:

a. Two dimensional setpoint target array (r).

b. Two dimensional setpoint target bumps ($\delta r$).

c. Two dimensional scanner profile measurements (y).

d. Two dimensional actuator profile array (u).

To illustrate the utility of the inventive technique, computer simulations implementing the reverse bump test for closed-loop identification were conducted using Matlab R12 software from Mathworks. The simulations modeled a papermaking machine as depicted in FIG. 4 with a headbox having 45 actuators that controlled pulp stock discharge through the corresponding slice lip opening. The weight of the finished paper was measured by a scanner at 250 points or bins across the width of the paper from the front to back side of the machine; each bin represents a distance of about 5 mm. The weight of the finished paper had a mean value of about 191 lb per 1000 units of sheet. The model also simulated closed-loop control of the actuators in response to signals from the scanner.

Figure 5A:
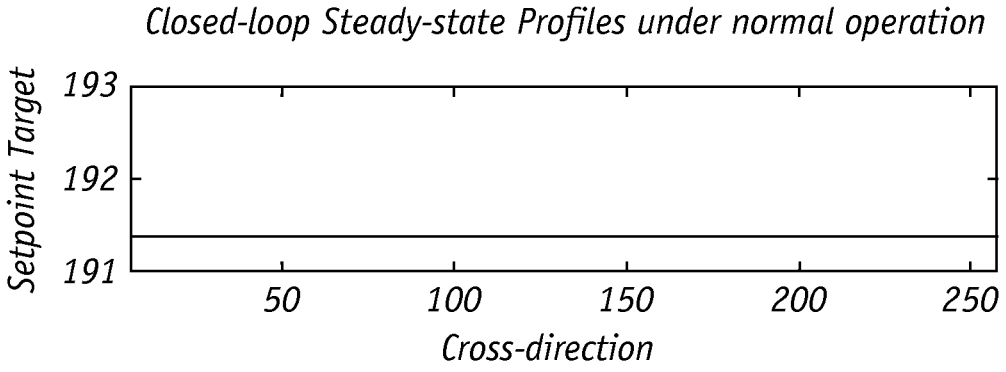
FIGS. 5A, 5B, and 5C are the setpoint target, actuator and measurement profiles vs. CD position, respectively, in a normal steady-state closed-loop operation.
Figure 5B:
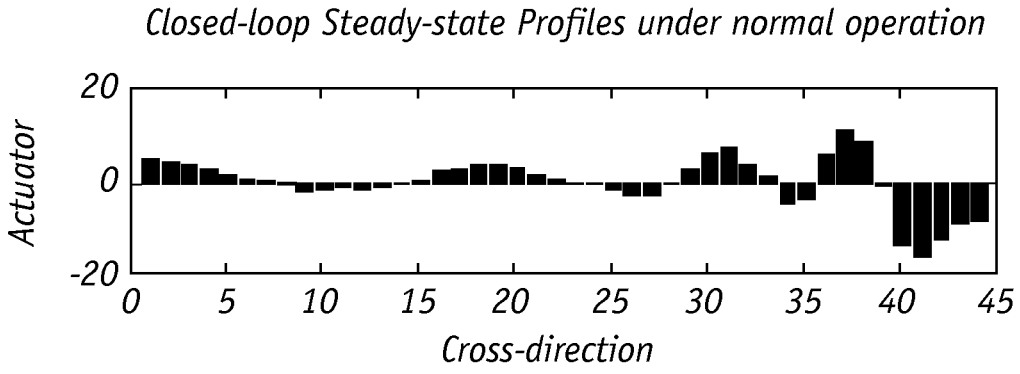
Figure 5C:
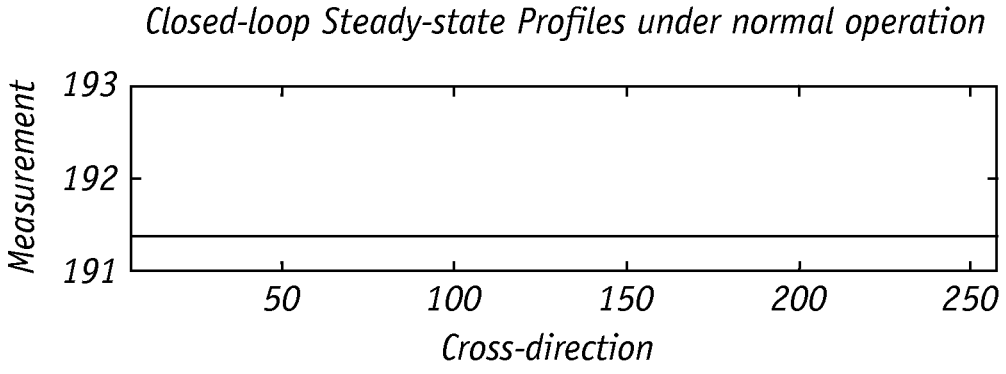

FIGS. 5A and 5C show the setpoint target and measurement profiles for paper vs. CD position in a normal steady-state closed loop operation. As is apparent, the setpoint target and measurement profiles for the finished paper are essentially the same and are represented by horizontal profiles depicting paper that has a weight of slightly more than 191 lb per 1000 units of sheet. Note that an actual papermaking machine would typically not have such a flat measurement profile y as there are typically uncontrollable high spatial frequency components that are not removed by the controller and do not affect this analysis. FIG. 5B is the headbox actuator profile and shows how the flow of pulp through the slices in the headbox varies across the headbox. The change in actuator response is relative to a baseline of zero. These profiles illustrate the appearance of the cross-directional control system prior to performing the "reverse bump test" experiment.

Figure 6A:
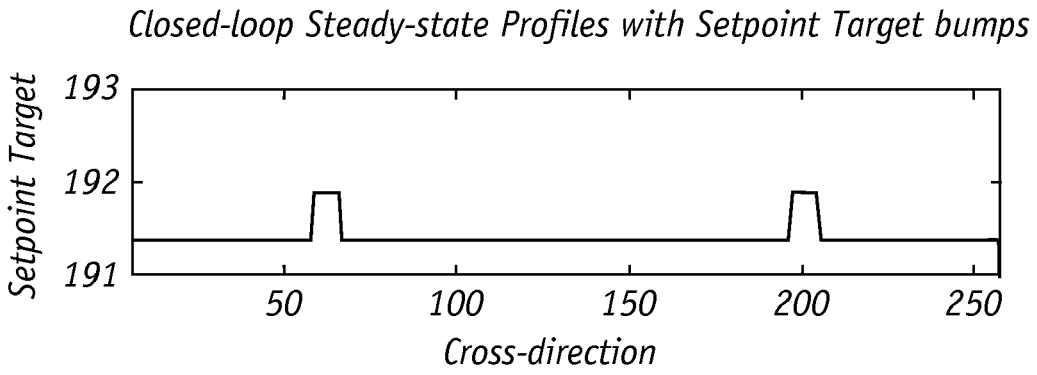
FIG. 6A shows the setpoint target that is modified with "bumps" at ¼ (low side) and ¾ (high side) across the paper.
Figure 6B:
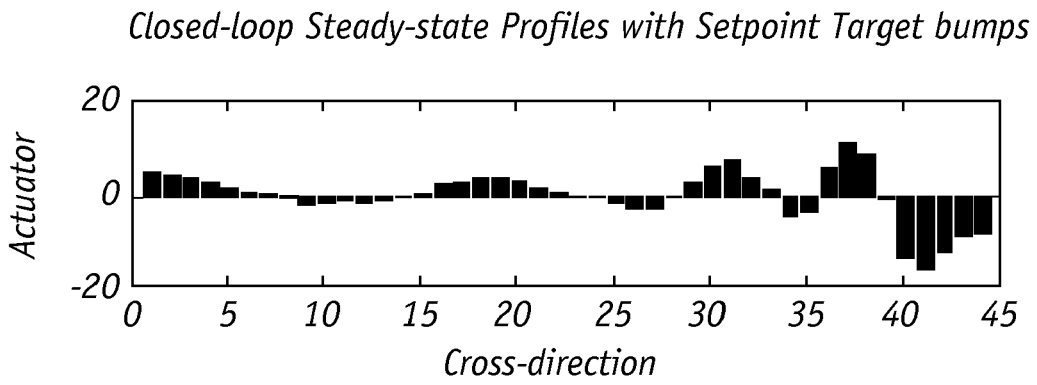
FIGS. 6B and 6C show the actuator and measurement profiles vs. CD positions, respectively, in a closed loop steady-state operation with setpoint target bumps.
Figure 6C:
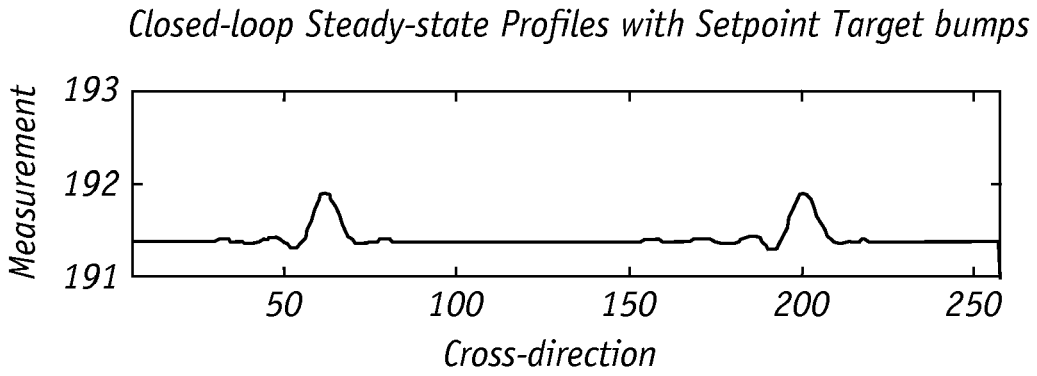

FIGS. 6A and 6C show the setpoint target and measurement profiles for paper vs. CD position in a steady-state closed loop operation after the setpoint target has been modified with 'bumps' at ¼ and ¾ across the paper sheet. As is apparent, the modifying setpoint target causes a corresponding change in the measurement profile for the finished paper. FIG. 6B is the headbox actuator profile and shows the slice jack actuator positions across the headbox. These profiles illustrate the appearance of the cross-directional control system during the "reverse bump test" experiment once the closed-loop has reached the steady-state.

Figure 7A:
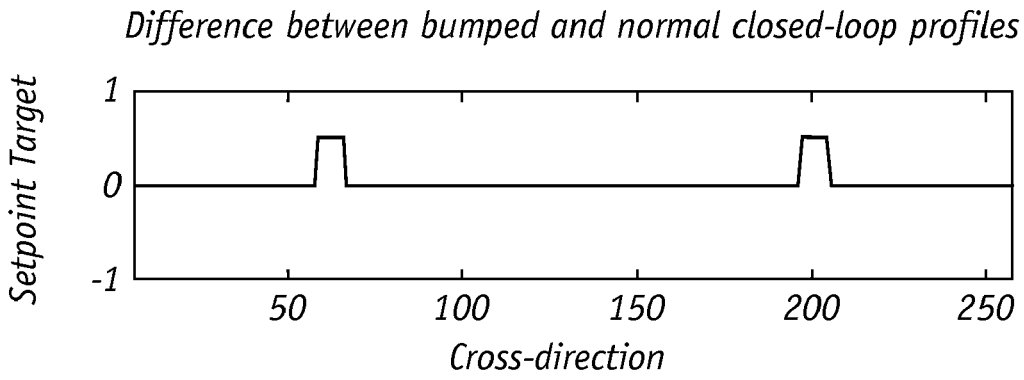
FIGS. 7A, 7B, and 7C show the difference between the closed-loop profiles representing normal steady-state closed loop operation in FIGS. 5A, 5B, and 5C and the closed-loop steady-state profile with setpoint target bumps of FIGS. 6A, 6B, and 6C.
Figure 7B:
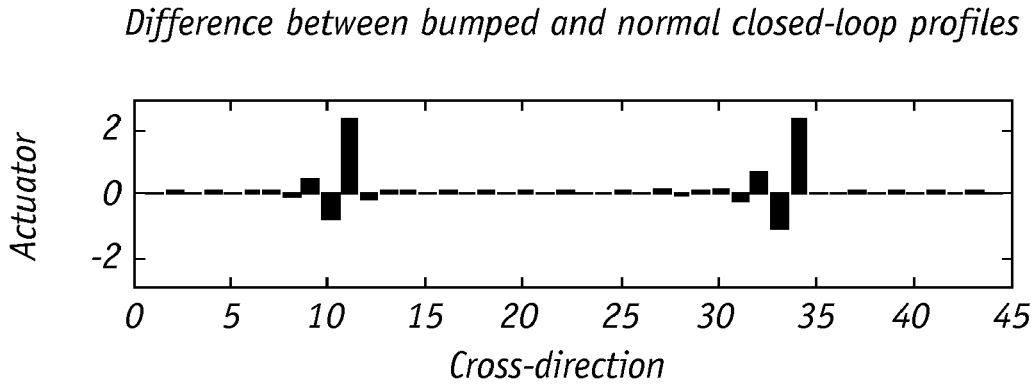
Figure 7C:
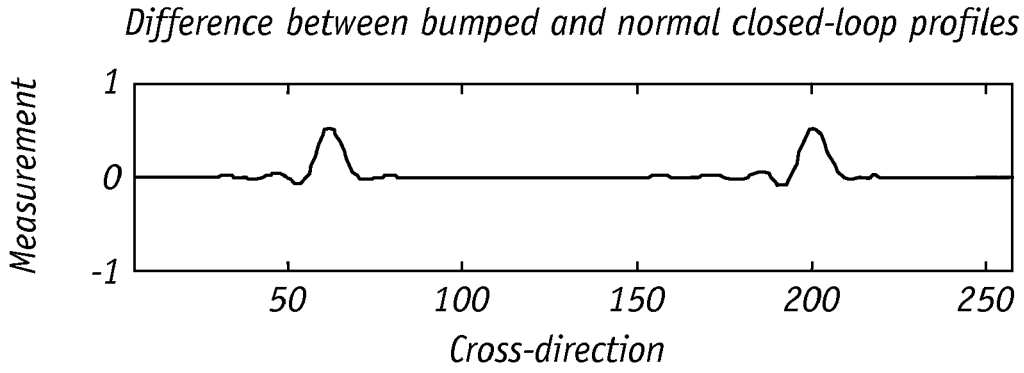

Alignment Identification Algorithm a. Using standard techniques, the response of the actuator profile to the setpoint target bumps is computed. In one preferred method, the actuator profile can be computed as the difference between the baseline actuator profile (prior to bumps) and the steady-state actuator profile (after bumps are inserted). As an illustration, FIGS. 7A, 7B, and 7C are the difference between the closed-loop target setpoint, actuator and measurement profiles. The actuator array illustrated is denoted as $u_{resp}$. Specifically, the actuator profile plotted in FIG. 7B was computed by subtracting the normal operation closed-loop actuator profile in FIG. 5B from the closed-loop actuator profile resulting from the setpoint target bumps in FIG. 6B, $$u_{resp}=r_{bump}-u_{normal}$$

Figure 8A:
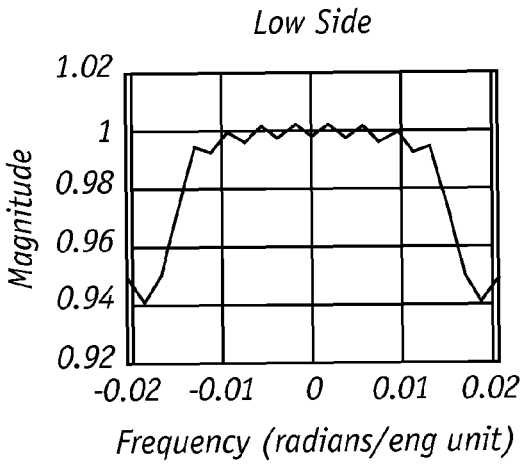
FIGS. 8A and 8C are the graphs of gain vs. frequency of the low side and high side actuator responses to reverse bump tests, respectively.
Figure 8C:
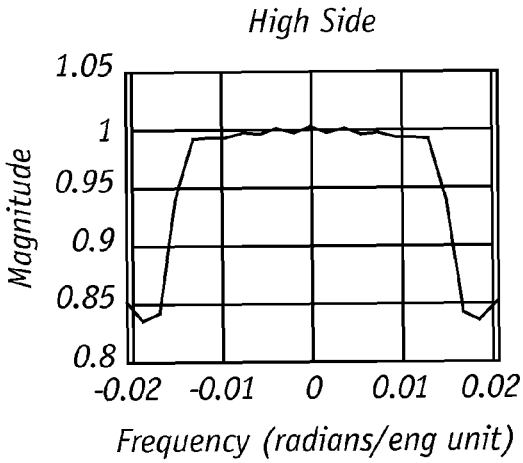
Figure 8B:
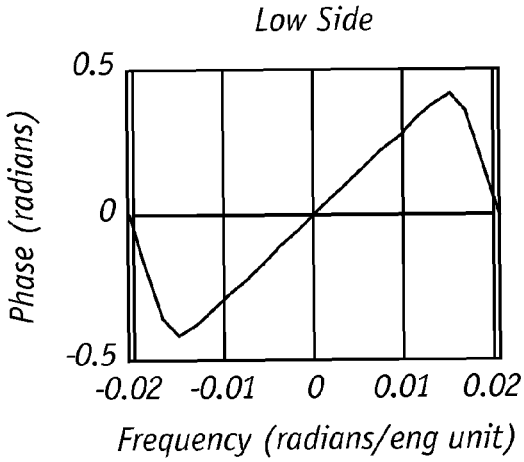
FIGS. 8B and 8D are the graph of low-frequency phase vs. frequency of the low side and high side actuator responses; and For FIG. 9, the asterisks plot the slopes of the zero frequency phases illustrated in FIGS. 8B and 8D vs. CD positions of the induced setpoint target bumps that are positioned approximately ¼ and ¾ of the way across the paper; the straight line in FIG. 9 is a straight line fit between these two data appoints.
Figure 8D:
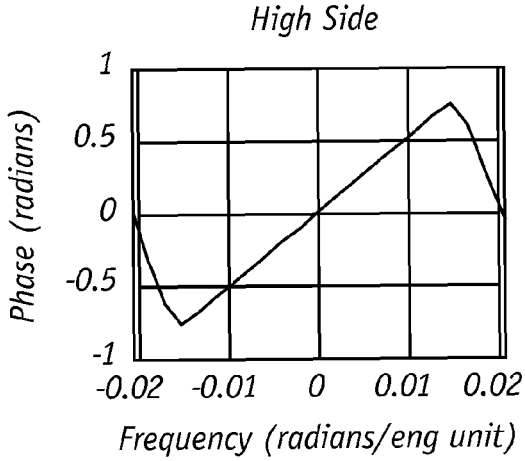

The 1-dimensional array profiles $u_{normal}$ and $u_{bump}$ are the best estimates of the actuator profile during the baseline collection and the actuator profile for the system having reached steady-state after the bumps.

b. Next the actuator response profile and the setpoint target bump profile (as illustrated in the graphs in FIGS. 7B and 7A) are partitioned in the middle to make two arrays of approximately equal length:

$$u_{resp}=\begin{bmatrix} u_{low} \\ u_{high} \end{bmatrix} \quad \delta r=\begin{bmatrix} \delta r_{low} \\ \delta r_{high} \end{bmatrix}$$

c. Compute the Fourier transforms of each of the component arrays:

$$U_{low}^{f}=fft(u_{low})\delta R_{low}^{f}=fft(\delta f_{low})$$

$$U_{high}^{f}=fft(u_{high})\delta R_{high}^{f}=fft(\delta f_{high})$$

d. Now the closed-loop spatial frequency response of the low end of the sheet and the high end of the sheet may be given by:

$$T_{low}^{f}=U_{low}^{f}./\delta R_{low}^{f}$$

$$T_{high}^{f}=U_{high}^{f}./\delta R_{high}^{f}$$

where "./" denotes element-by-element division.

e. For CD control systems, the low-frequency components of the arrays $T_{low}^{f}$ and $T_{high}^{f}$ will be equal to the inverse of the frequency response of the process itself, as practical cross-directional control will eliminate all low spatial frequency components of the steady-state error profile e=r−y, thus meaning that the actuator profile u contains exactly the correct alignment at low spatial frequencies. Thus the low frequency phase information in the arrays $T_{low}^{f}$ and $T_{high}^{f}$ will contain the true alignment information of the system.

e. The phase information of phase($T_{low}^{f}$) and phase($T_{high}^{f}$) could potentially be used directly. Alternatively, as illustrated here, the possibility of using the reverse bump test to compute the alignment change between two reverse bump tests that are performed perhaps days/weeks/months apart was considered. In this case, the alignment change between the alignment at the time of an "old" reverse relative to the alignment at the time of a "new" reverse bump test is computed, as follows:

$$H_{low}^{f}=U_{low}^{f}(\text{new})./U_{low}^{f}(\text{old})$$

$$H_{high}^{f}=U_{high}^{f}(\text{new})./U_{high}^{f}(\text{old})$$

then the phase information phase($H_{low}^{f}$) and phase($H_{high}^{f}$) are plotted with respect to the spatial frequency v as shown in FIGS. 8B and 8D, respectively.

g. A straight line through the low frequency components of phase($H_{low}^{f}$) and phase($H_{high}^{f}$) is fitted through the low frequency components of the two plots of FIGS. 8B and 8D, respectively. For the example illustrated in FIG. 8, the low side phase (FIG. 8B) has a slope of 29.5 engineering units at zero frequency. Since the simulation used millimeters, the slope is 29.5 mm). The high side phase (FIG. 8D) has a slope of 50.9 mm at zero frequency. The y-axis intercepts of these straight lines should naturally be zero (and this can be constrained during the curve fit). The slope of this straight line is equal to the change in the alignment of the paper sheet at the CD positions of the low bump and the high bump, respectively.

h. Since it was assumed the change in alignment to be linear, the fact that at least two well-spaced bumps were employed allowed the two slopes to determine the two degrees of freedom assumed for the linear change in alignment. A straight line is drawn between the two measured points in FIG. 9 to model the change in alignment for the overall sheet as a function of the cross-directional position. Specifically, in FIG. 9, the slopes of the zero frequency phases illustrated in FIG. 8, i.e., 29.5 mm and 50.9 mm, were plotted against the CD position of the induced setpoint target bumps (δr) which are positioned approximately ¼ and ¾ of the way across the sheet as described above. It was assumed that the change in alignment was linear across the sheet width. The line in the graph is an alignment update computed from a linear fit between the two data points computed from the data obtained during the reversed bump test. A linear alignment shift is the most common experienced on actual papermaking machines. As is evident, other models of alignment can be accommodated and would simply involve a different distribution of the induced setpoint target bumps (δr).

Figure 9:
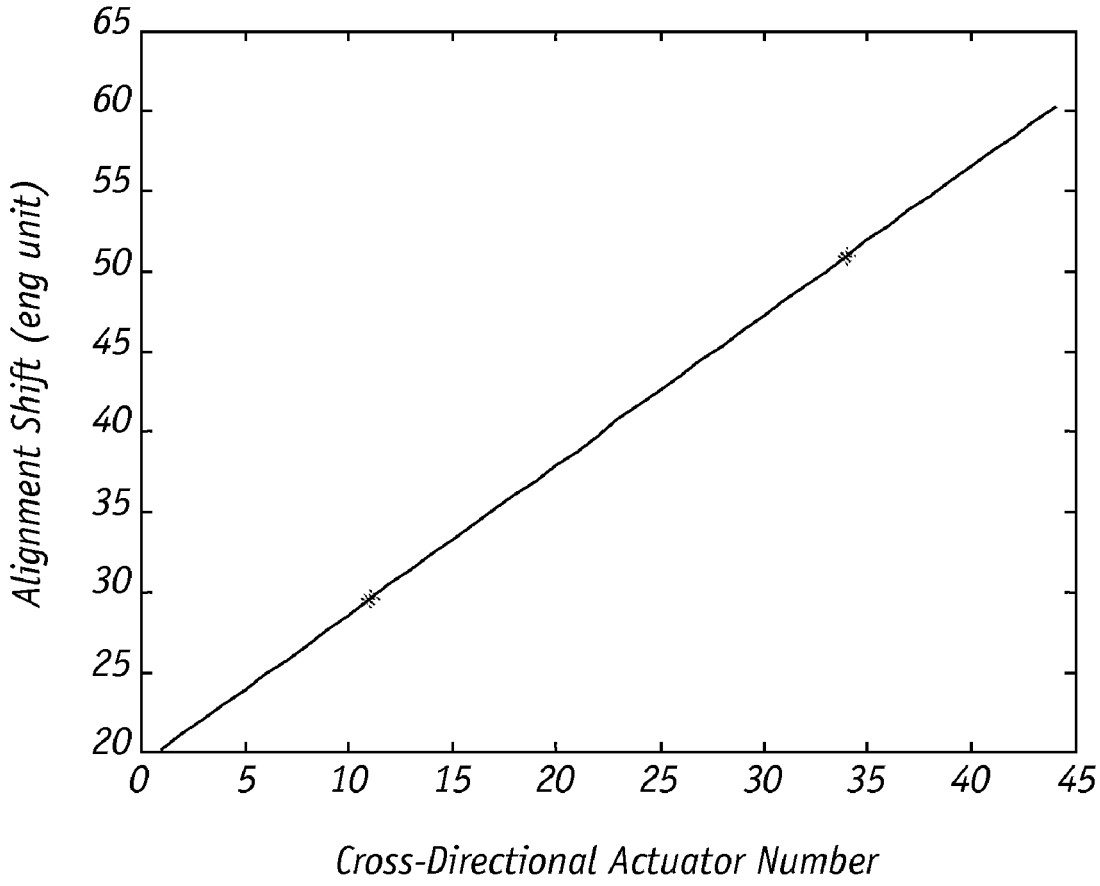

If a more complicated nonlinear shrinkage pattern is assumed, then the above procedure could be modified to identify the nonlinear alignment change. This can be accomplished by designing more than two well-spaced bumps. This could potentially require the bumps to be staggered in time. For example, the bumps can be implemented sequentially. Finally, the change in cross-directional controller alignment as a function of cross-directional position on the sheet has been computed, e.g., as illustrated in FIG. 9. This function can then be used to update the alignment of the online cross-directional controller. A CD control system will perform at its best when the controller alignment matches the true alignment of the paper sheet and the actuators.

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A system for alignment of a sheetmaking system having a plurality of actuators arranged in the cross-direction wherein the system includes a controller for adjusting output to the plurality of actuators in response to sheet profile measurements that are made downstream from the plurality of actuators, the system comprising:

(a) means for determining alignment information from at least two cross-directional positions that includes:

(i) means for measuring a profile of the sheet along the cross-direction of the sheet downstream from the plurality of actuators;

(ii) means for generating a profile signal that is proportional to a measurement profile;

(iii) mean for adding a perturbative signal to the profile signal to generate a first modified profile signal that simulates a disturbance at a position along the measurement profile or for adding a perturbative signal to a setpoint target profile to generate a second modified profile, signal that simulates a setpoint change at a position along the measurement profile wherein the plurality of actuators is connected to a perturbed profile measurement, a setpoint, or an error, which is the difference between the setpoint and the perturbed profile measurement in the closed-loop through the controller; and (iv) means for determining alignment shift information based on a closed-loop steady-state response of an actuator profile to the first or second modified profile signal; and (b) means for identifying the changes in alignment of the sheetmaking system, if any, from the alignment shift information from at least two cross-directional positions.

2. The system of claim 1 wherein the means for measuring the profile comprises a detector that measures a physical characteristic of the sheet along the cross direction.

3. The system of claim 1 wherein the means for determining, alignment shift information ascertained ascertains the information essentially simultaneously and the at least two cross-directional positions are sufficiently spaced apart such that each set of actuator responses is substantially not coupled.

4. The system of claim 1 wherein the means for determining alignment information includes means for adding a perturbative signal to the profile signal to generate a first modified profile signal that simulates a disturbance at a position along a cross direction of the sheet with respect to the measurement profile.

5. The system of claim 1 wherein the means for determining alignment shift information records steady-state actuator responses for each of the first or second modified profile signal and the system includes means for determining the alignment information from the steady-state actuator responses.

6. The system of claim 5 wherein the means for determining alignment shill information includes means for analyzing frequency responses from the plurality of actuators employs.

7. The system of claim 6 comprising means for analyzing low spatial frequency actuator responses.

8. The system of claim 1 wherein the means for identifying the changes in alignment includes means for developing a transfer function for changes in alignment.

9. The system of claim 1 wherein the plurality of actuators are positioned in the cross-directional along one or more locations of a papermaking machine.

10. The system of claim 1 wherein the mean for adding a perturbative signal to the profile signal to generate a first modified profile signal that simulates a disturbance at a position along the measurement profile or for adding a perturbative signal to a setpoint target profile to generate a second modified profile signal that simulates a setpoint change at a position along the measurement profile is configured does not perturb the plurality ref actuators.

11. The system of claim 1 wherein the means for measuring the profile comprises a scanning sensor that is located downstream of from the plurality of actuators.

12. The system of claim 1 comprising means for adding a perturbative signal to the profile signal to generate a first modified profile signal that simulates a disturbance at a position first along a along a cross direction of the sheet with respect to the measurement profile.

13. The system of claim 12 wherein the means for determining alignment shift information records steady-state actuator responses for each of the first modified profile signal and the system includes means for determining the alignment information from the steady-state actuator responses.

14. The system of claim 13 wherein the means for determining alignment shin information includes means for analyzing frequency responses from the plurality of actuators.

15. The system of claim 14 comprising means for analyzing low spatial frequency responses are.

16. The system of claim 12 wherein the means for identifying the changes in alignment includes means for developing a transfer function for changes in alignment.

17. The system of claim 12 wherein the plurality of actuators are positioned in the cross-directional along one or more locations of the papermaking machine.

18. The system of claim 12 wherein the mean for adding a perturbative signal to the profile signal to generate a first modified profile signal that simulates a disturbance at a position along the measurement profile is configured not perturb the plurality of actuators.

19. The system of claim 12 wherein the means for measuring the profile comprises a scanning sensor that is located downstream of from the plurality of actuators.

20. The system of claim 12 wherein the means for determining alignment shift information two ascertains the information essentially simultaneously and the at least two cross-directional positions are sufficiently spaced apart such that each set of actuator responses is substantially not coupled.

* * * * *